US007051816B2

(12) United States Patent
Khomynets

(10) Patent No.: US 7,051,816 B2
(45) Date of Patent: May 30, 2006

(54) WELL JET DEVICE FOR WELL TESTING AND DEVELOPMENT AND OPERATING METHOD FOR THE WELL JET DEVICE

(76) Inventor: Zinoviy Dmitrievich Khomynets, d.33, ul. Vilshanetskaya, Tismenitsa, obl.Ivano-Frankovskaya (UA) 77400

( * ) Notice: Subject to any disclaimer, the term of this patent is extended or adjusted under 35 U.S.C. 154(b) by 126 days.

(21) Appl. No.: 10/477,729

(22) PCT Filed: May 28, 2002

(86) PCT No.: PCT/RU02/00260

§ 371 (c)(1),
(2), (4) Date: Nov. 14, 2003

(87) PCT Pub. No.: WO03/012299

PCT Pub. Date: Feb. 13, 2003

(65) Prior Publication Data

US 2004/0134663 A1 Jul. 15, 2004

(30) Foreign Application Priority Data

Jul. 31, 2001 (RU) ..... 2001121298

(51) Int. Cl.
*E21B 43/12* (2006.01)

(52) U.S. Cl. ..... 166/372; 166/68; 166/105

(58) Field of Classification Search ..... 166/105, 166/106, 65.1, 68, 62, 72, 250.01, 370, 372; 417/372

See application file for complete search history.

(56) References Cited

U.S. PATENT DOCUMENTS 2,954,742 A * 10/1960 Williams ..... 166/68
3,716,102 A * 2/1973 Tubbs ..... 166/85.2
4,293,283 A 10/1981 Roeder
4,603,735 A * 8/1986 Black ..... 166/68

(Continued)

FOREIGN PATENT DOCUMENTS

RU 2129672 4/1999

(Continued)

*Primary Examiner*—Kenneth Thompson
(74) *Attorney, Agent, or Firm*—Dellett & Walters

(57) ABSTRACT

The invention relates to jet devices for extracting oil from wells and intensifying the oil influx rate. An output cone, a packer and a jet pump are mounted on a tubing string. One or several active nozzles are arranged inside the pump body, and a stepped pass channel provided with a mounting seat for a pressure-sealing unit which is disposed between stages and several channels for supplying a pumped-out medium are embodied inside said pump body. The axes of the nozzles are disposed in a parallel position with respect to the axis of the pass channel at a certain distance therefrom. The inventive device is provided with a radiator and a receiver-transducer of physical fields mounted on a cable in such a way that it is replaceable by other instruments. Said cable passes through the axial channel of the sealing unit which is arranged in such a way that it is successively replaceable by functional inserts such as a testing and depression inserts etc. Said inserts are provided with mechanisms for bringing them to the pump body and for extraction therefrom. Mounting seats for back valves and plugs are embodied in the lower part of the channels for supplying the pumped-out medium. The dimension ratios of the elements of the inventive device are also disclosed. The aim of the invention is to optimise the dimensions of the elements of said device and increase the performance thereof.

2 Claims, 6 Drawing Sheets

U.S. PATENT DOCUMENTS 4,744,730 A 5/1988 Roeder
4,988,389 A * 1/1991 Adamache et al. ..... 166/302
6,135,210 A * 10/2000 Rivas ..... 166/372

FOREIGN PATENT DOCUMENTS

SU 1146416 3/1985

* cited by examiner

WELL JET DEVICE FOR WELL TESTING AND DEVELOPMENT AND OPERATING METHOD FOR THE WELL JET DEVICE

FIELD OF INVENTION

This invention relates to the field of pumping engineering, mainly to well jet devices for oil production and intensification of oil inflow from wells.

PRIOR ART

Known in the art is a well jet device comprising a jet pump installed on the piping string in the well and a transmitter and a receiver-transducer arranged below the jet pump (RU 2129671 C1).

From the above source known is a method of operation of a well jet device, which includes lowering in the well a piping string with a jet pump, a packer and a transmitter and a receiver-transducer of physical fields, the latter being arranged below the jet pump.

The known device and method enable to explore wells and pump various extracted media, e.g., oil, out of wells, at the same time exploring the well, the transmitter and receiver of physical fields being arranged with the possibility of moving back and forth along the well relative to the jet pump and the stratum.

But in some cases this is insufficient for obtaining reliable information on the well condition, which reduces the efficiency of works performed in order to intensify oil production.

The closest, as to its technical essence and the achievable result, to this invention in the part of the device as the object of the invention is a well jet device for testing and developing wells, which comprises a packer, and a jet pump installed on the piping string, the body of the said pump comprising a stepped through passage with a mounting seat between steps for installing a sealing assembly with an axial passage, the said body of the well jet device being provided with several mounting seats for installing plugs or active nozzles having mixing chambers and diffusers, the said device being provided with a well pressure gauge, a sampling device and a flowmeter, all of them being installed either on the sealing assembly or on a cable on the input side of the jet pump for the pumped out medium (RU 2129672 C1).

Known from the same patent as the closest, as to its technical essence and the achievable result, to this invention in the part of the method is the method of operation of a well jet device, which includes installation, on the piping string, of a packer and a jet pump in the body of which a through passage is made with a mounting seat, lowering of the whole assembly into the well, release of the packer and arrangement of well instruments below the jet pump.

The known well jet device and the method of operation of the well jet device enable to carry out various process operations in the well below the level at which the jet pump is installed, including those performed by lowering pressure difference above and below the sealing assembly.

But, the known well jet device and the method of operation do not enable to exploit the potential of the device in full due to non-optimal sequence of operations and dimension relations of various structural elements of the well jet device.

DISCLOSURE OF INVENTION

The objective of this invention is to optimize the dimensions of various components of the construction of the well jet device and the sequence of operations when carrying out works on intensifying the well exploitation and, owing to it, to raise the efficiency of well jet device operation in developing and testing wells.

The stated objective in the part of the device as the object of the invention is achieved owing to the fact that the well jet device for testing and developing wells comprises, installed on the piping string down-top, an input cone with a shank, a packer with a through passage and a jet pump, in the body of which one or several active nozzles with the respective mixing chambers and passages for supplying the active medium are axially arranged and a stepped through passage is made with a mounting seat between steps for installing a sealing assembly having an axial channel, the said device being provided with a transmitter and a receiver-transducer of physical fields, which is arranged at the jet pump side for entry of the medium pumped out of the well and installed on a cable or a wire fed through the axial passage of the sealing assembly, the output of the jet pump is connected to the piping string above the sealing assembly, the input side of the jet pump passage for supplying the pumped out medium is connected to the piping string below the sealing assembly, and the input side of the passage for supplying the working medium to the active nozzle is connected to the space surrounding the piping string, and in the body of the jet pump several passages for supplying the pumped out medium are made, the input cross-section of the input cone is located not lower than the roof of the productive stratum, the total area of the cross-sections of the passages for supplying the active medium is not less that the total area of the output cross-sections of the active nozzles, the axis of each active nozzle is parallel to the axis of the through passage in the body of the jet pump and is located from the latter at the distance L being not less than 0.55 diameter $D_1$ of the bigger step in the through passage made in the body of the jet pump or at the distance L being not less than 0.575 diameter $D_2$ of the lesser step in the through passage made in the body of the jet pump and located below the mounting seat, the sealing assembly is movably arranged on the well-logging cable or a wire fed through the axial passage in the sealing assembly and installed with the possibility of being alternatively replaced by the functional inserts, namely, a hydrostatic testing insert, a depression insert, a blocking insert which is made with or without a bypass passage, an insert for recording curves of stratum pressure restoration in the under-packer space and an insert for hydrodynamic vibration impact on the near-well zone of the productive stratum; the diameter $D_3$ of the axial passage in the sealing assembly is not greater than 0.6 outer diameter $D_4$ of the sealing assembly, the axes of the sealing assembly and the functional inserts are aligned with the axis of the through passage in the jet pump; the functional inserts are made with the possibility of installing below them autonomous well instruments as well as have, in their upper part, a tool for delivery and removal of them from the body of the jet pump with the use of cable equipment, the well-logging cable or wire are made with a cap for attaching well instruments, the sealing assembly being made with the possibility of installing it on the well-logging cable or wire without disconnecting the cap from them, the transmitter and receiver-transducer of physical fields is connected to the cap of the well-logging cable with the possibility of being replaced by other well instruments, e.g., a perforator, an ultrasonic transmitter, a thermometer, a pressure gauge, a flowmeter, a sampling device, which all may be lowered, either in turns or in one assembly, along the through passage of the jet pump body on the well-logging cable or wire into the well, the outer diameter $D_5$ of the jet pump body is at least 2 mm less than the inner diameter $D_6$ of the casing string in the well where it is installed, the diameter $D_4$ of the sealing assembly is at least 1 mm less than the inner diameter $D_7$ of the piping string above the jet pump, the diameter $D_8$ of the transmitter and receiver-transducer of physical fields is at least 1 mm less than the diameter $D_2$ of the lower step of the through passage in the jet pump body and than the diameter $D_9$ of the through passage in the packer, the diameter $D_{10}$ of the well-logging cable or wire is at least 0.001 mm less than the diameter $D_3$ of the axial passage in the sealing assembly, and in the lower part of the passages for supplying the pumped out medium positions for installing check valves or plugs are made.

In the part of the method as the object of the invention the stated objective is achieved owing to the fact that in the method of operation of the well jet unit in testing and developing wells consists in installing on the piping string, down-top, of an input cone with a shank, a packer and a jet pump in the body of which a stepped through passage with a mounting seat in made between the steps, lowering that assembly into the well, arranging the input cone not below the roof of the productive stratum, then a transmitter and receiver-transducer of physical fields is lowered into the well and arranged below the jet pump, during lowering background measurements of temperature and other physical fields from the wellhead to the well bottom are taken, and the transmitter and receiver-transducer of physical fields is removed from the well, then the packer is released, a blocking insert with a well pressure gauge is dropped into the inner cavity of the piping string, the blocking insert being seated onto the mounting seat in the through passage, the said blocking insert separates the well area into the hole clearance and the space inside the piping string, then the packer is pressure-tested by way of supplying the working agent into the hole clearance, then the blocking insert is removed with the use of cable equipment, and the transmitter and receiver-transducer of physical fields is lowered into the well together with the sealing assembly, which is movably arranged on the well-logging cable or wire above the cap on which the transmitter and receiver-transducer of physical fields is installed, the sealing assembly is installed onto the mounting seat in the through passage of the jet pump while ensuring the possibility of back and forth motion of the well-logging cable or wire, then the transmitter and receiver-transducer of physical fields is arranged in the explored interval of the productive stratum, and, by supplying the working medium to the active nozzle(s) of the jet pump, several values of pressure drawdown on the stratum are successively created, and, at each value, bottom-hole pressures, the composition of the fluid coming from the stratum and the well flow rate are measured, after which the parameters of physical fields and those of bottom-hole pressure are recorded when moving the transmitter and receiver-transducer of physical fields along the well axis in the speed range from 0.1 to 100 meters per minute and at pressure drawdown values changing stepwise in the range from 0.01 to 0.99 stratum pressure or at a set value of pressure drawdown when the jet pump is either operated or shut down, then the transmitter and receiver transformer of physical fields is lifted out of the well and at the same time physical fields from the input cone to the wellhead are registered, and the functional insert for recording curves of stratum pressure restoration in the under-packer zone is lowered on the well-logging cable or wire, the said insert being provided with a pressure sensor and a sampling device, and installed in'the through passage of the jet pump, a required pressure drawdown on the stratum is created with the use of the jet pump, and, after sharp stopping of supplying the liquid working medium to the jet pump, a stratum pressure restoration curve for the under-packer well zone is recorded, said recording of stratum pressure restoration curves may be done repeatedly at different initial pressure drawdown on the stratum; after that the results of exploration and testing the well are processed, and a decision is taken whether other repair works on the well are necessary in order, e.g., to raise its productivity or ensure waterproofing, such works being conducted with the use of the assembly with the jet pump, which is in the well, as well as with the alternatively changed functional inserts as well as instruments lowered into the well with the sealing assembly on the well-logging cable or wire, e.g., a perforator, an ultrasonic transmitter, a sampling device, a powder-charge pressure generator, etc., in particular with the use of an ultrasonic transmitter the stratum is impacted by acoustic waves in the pressure drawdown mode in order to de-mud the productive stratum, by using an ultrasonic generator with frequency switching and selective acting upon, first, less permeable and, then, more permeable seams of the productive stratum, and an increase in the well output is monitored, and after completion of the said works the cycle of well exploration is repeated.

The analysis of the well jet device has shown that the reliability and efficiency of its operation may be improved both by making various components of the device under strictly defined dimensions and by carrying out works in the well in a strictly defined succession. During the operation of the device different well modes are studied. It is required to install and remove the sealing assembly, to move the transmitter and receiver-transducer of physical fields along the well. It has been found that it is advisable to make the diameter of the bigger step in the through passage, which is located above the mounting seat for the sealing assembly, at least 0.5 mm greater than the diameter of the step in the through passage, which is located below the mounting seat, and the diameter of the axial passage in the sealing assembly should not exceed 0.6 outer diameter of the sealing assembly, and, at the same time, the diameter of the well-logging cable or wire should be at least 0.001 mm less than the diameter of the axial passage in the sealing assembly. In the result, the sealing assembly is securely installed on the mounting seat and possible overflows through the sealing assembly are minimized. The arrangement of the active nozzle axis at a distance not less than 0.55 diameter of the bigger step in the through passage or at a distance not less than 0.575 diameter of the lesser step in the through passage in the jet pump body, when making the nozzle axis parallel to the axis of the through passage, enables to determine the least possible distance between the axis of the active nozzle and that of the through passage of the jet pump and, consequently, enables to determine the maximum permissible dimensions of the jet pump body that is of much importance, since the diameter of the well is the main limiting factor when arranging equipment in the well. The possibility of replacing the sealing assembly with other functional inserts and the possibility of placing, instead of the transmitter and receiver-transducer of physical fields, other well instruments, in particular a perforator, an ultrasonic transmitter, a sampling device, a thermometer, a pressure gauge, etc., enables to conduct various works, e.g., to pressure-test the packer, transfer the well in the flow mode, conduct works on perforation of the productive stratum, its acid treatment, waterproofing works and a number of other operations without lifting the jet pump and the piping string from the well. In the result, the possibilities of the well jet device in conducting studies and repair and restoration works in the well are expanded and the time necessary for such works is significantly shortened. Making of inserts with the axis aligned with the axis of the through passage, as well as making the outer diameter of the jet pump body at least 2 mm less than the inner diameter of the casing string, the diameter of the sealing assembly at least 1 mm less than the inner diameter of the piping string above the jet pump and the diameter of the transmitter and receiver-transducer of physical fields at least 1 mm less than the diameter of the lower step in the through passage in the jet pump body and that of the through passage in the packer, enables to reduce the possibility of inserts and instruments lowered into the well being stuck in the process of their installation or removal, which increases the reliability of operation of the well jet device. The arrangement of the input cross-section of the input cone not lower than the roof of the productive stratum enables to preclude to the maximum extent the influence of the shank on the registered physical fields in the interval of the productive stratum.

Of no lesser importance is the rational organization of works aimed at exploring the well, which enable to obtain more adequate information on the condition of the well and the productive stratum, and, due to it, accelerate the process of restoring the well output. In particular, background measurements of temperature and other physical fields in the operation of lowering the transmitter and receiver-transducer of physical fields enable to get, prior to initiating inflow from the stratum, preliminary data on the present condition of the well, which makes it possible to elaborate practical measures for exploring the well and more adequately interpret the well exploration results in the mode of inflow from the stratum. Moving the transmitter and receiver-transducer of physical fields along the well, especially in the area of the productive stratum, both when the jet pump is operated or when it is shut down, enables to take dynamic and static characteristics of the well. In the course of exploration it has been found that adequate accuracy of obtained data may be obtained when moving the transmitter and receiver-transducer of physical fields with the speed from 0.1 to 100 meters per minute and at changing bottom-hole pressure stepwise in the range from 0.99 stratum pressure to 0.01 stratum pressure or, at least, at one of the set values of pressure drawdown. The installation of the functional inserts enables, apart from the above-stated possibilities, to organize different modes of well operation, in particular, it becomes possible not only to get data on the composition of the fluid coming from the productive stratum, but also take important characteristics of the well, such as record a stratum pressure restoration curve in the under-packer area, this possibility being achieved due to reduction in the bottom-hole pressure up to a value being 0.01 of the stratum pressure and subsequent sharp stopping of supply of the liquid working medium to the nozzle of the jet pump, and, what is most important, the well jet device enables to make recordings repeatedly at various modes in the above-stated range. As the result, the reliability of the obtained data is significantly improved. Another specific feature of the method of operation of the well jet device is the possibility of complex impact on the productive stratum, in particular, perforation of the stratum and the subsequent impact on the stratum with the use of an ultrasonic generator for creating a set level of pressure drawdown, which enables to perform the operation of de-mudding the productive stratum efficiently. All the above-indicated works may be conducted without numerous re-installations of the equipment in the well, which improves the efficiency of the well jet device greatly. After the completion of a cycle of the works on exploring and restoring the well workability, the whole cycle may be repeated, also without the necessity to re-install the equipment in the well. Thus, the scope of investigations carried out in the well has been expanded, which is of special importance when carrying out restoration works.

In the result, the objective of the invention—to optimize the succession of operations and the dimensions of various components of the well jet device—has been achieved, and, owing to that, the efficiency of operation of the well jet device has been improved.

PREFERRED EMBODIMENT OF THE INVENTION

Figure 1:
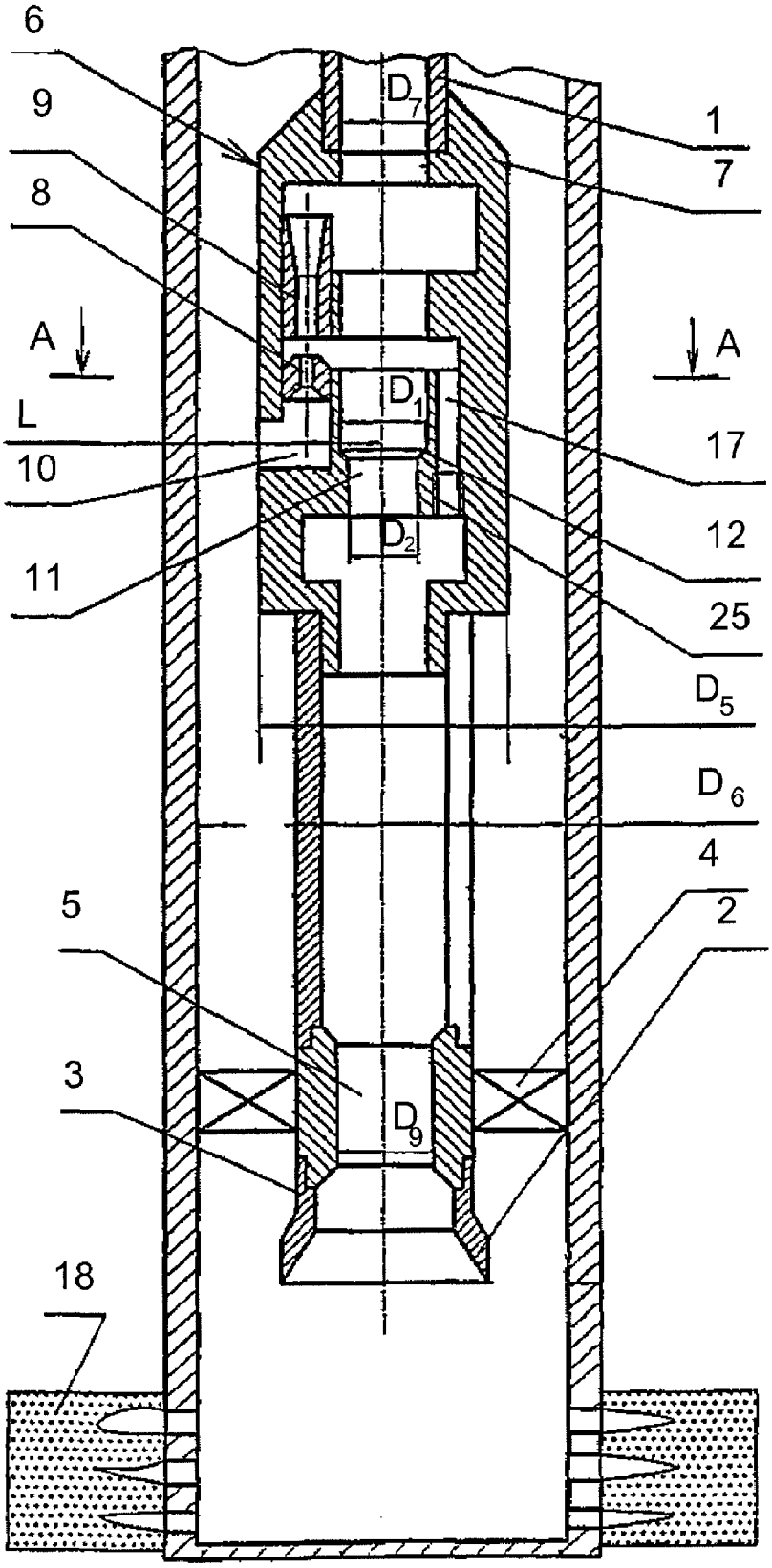
FIG. 1 is a longitudinal section of the well jet device described herein.
Figure 2:
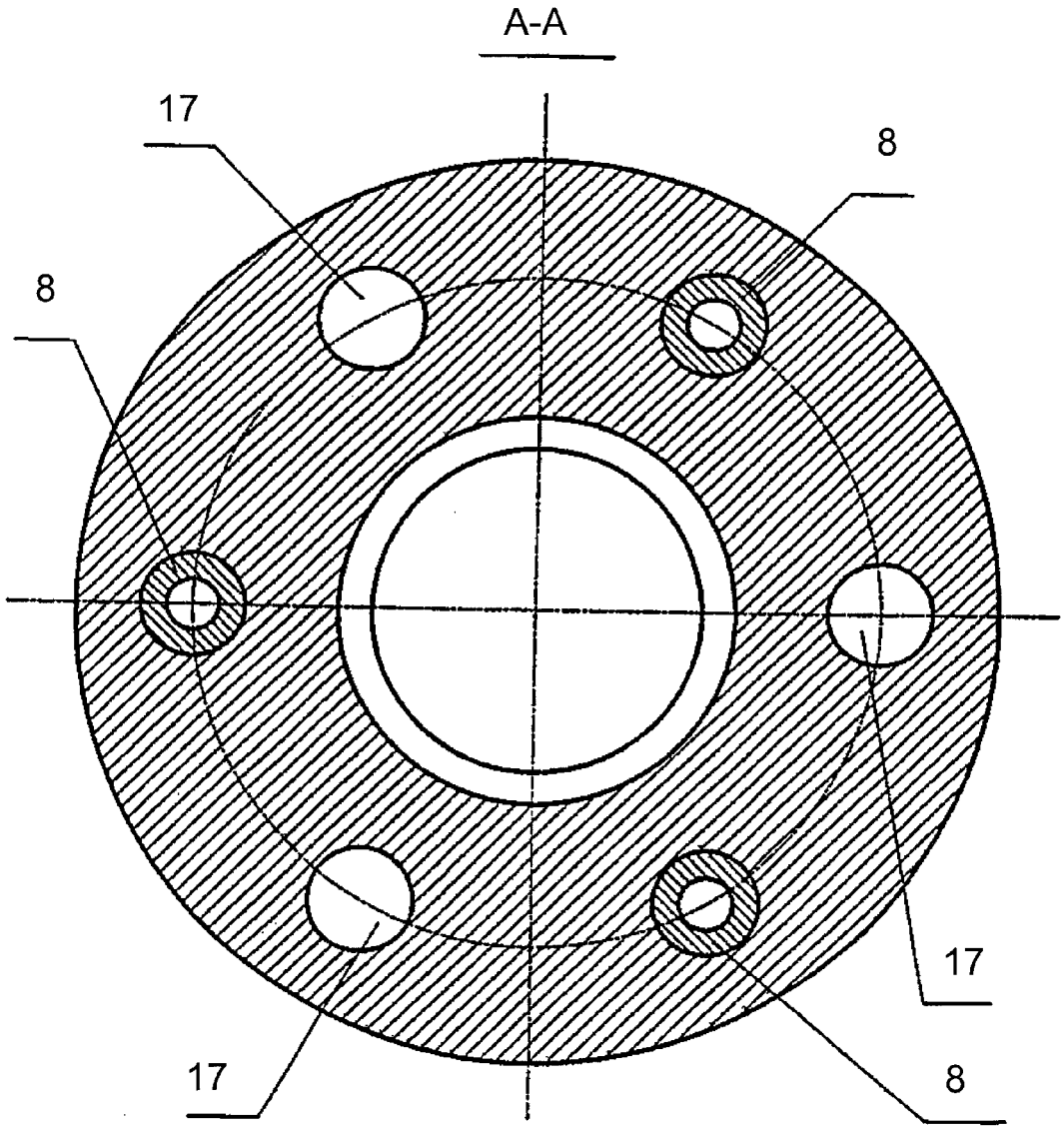
FIG. 2 is a longitudinal section of the well jet body along A—A line.
Figure 3:
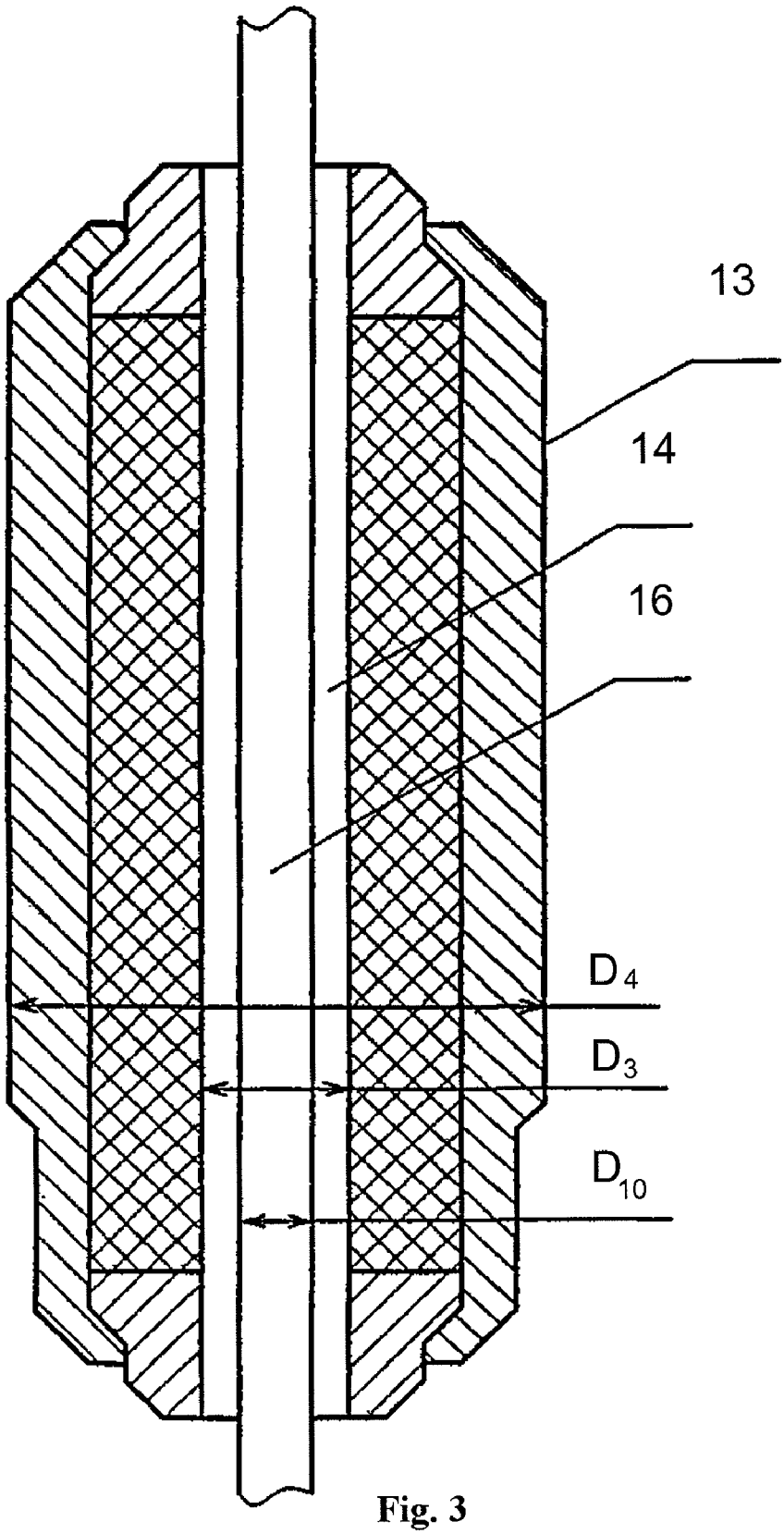
FIG. 3 is a longitudinal section of the sealing assembly.
Figure 4:
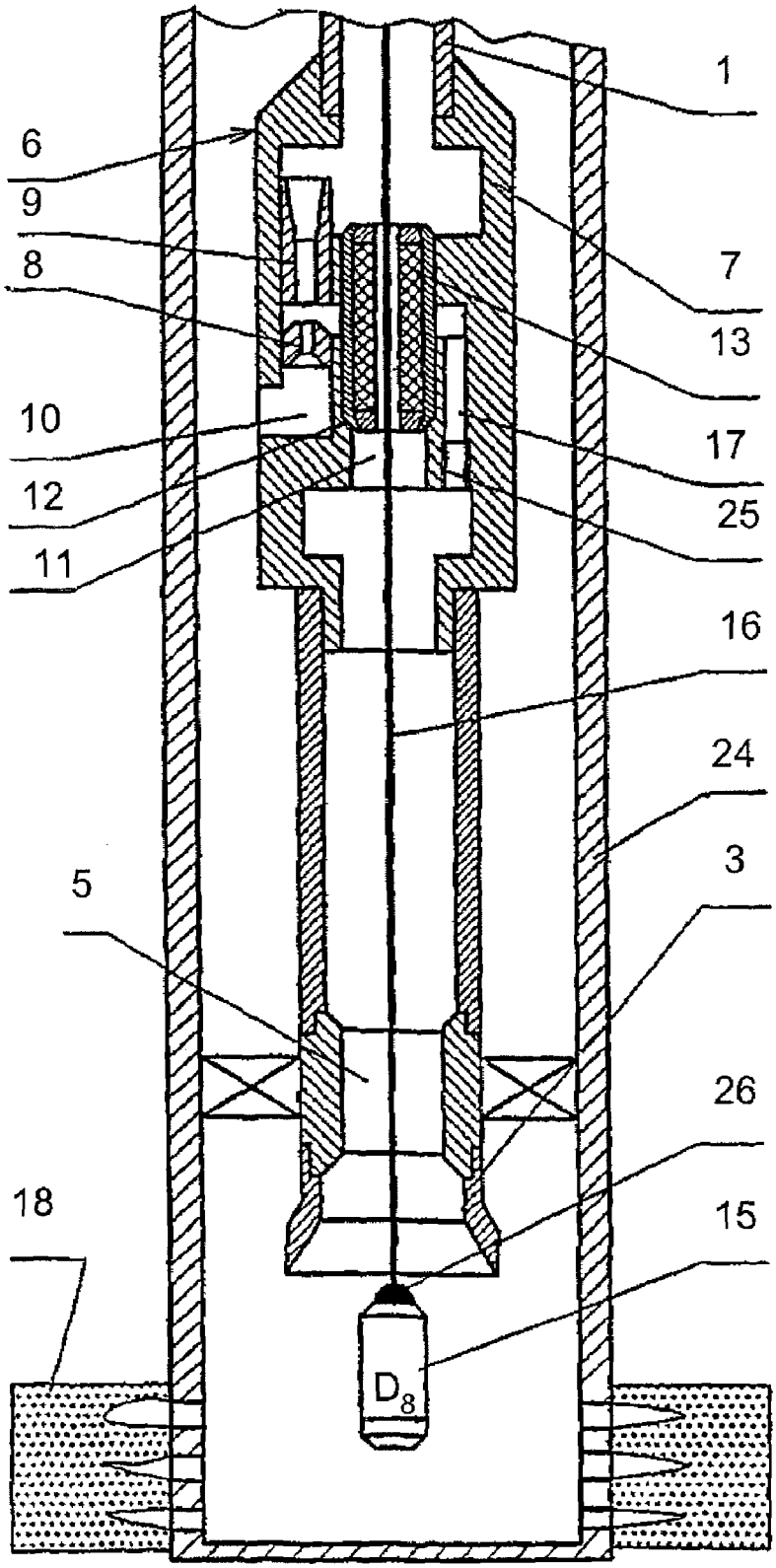
FIG. 4 is a longitudinal section of the well jet device with the sealing assembly installed in the through passage.
Figure 5:
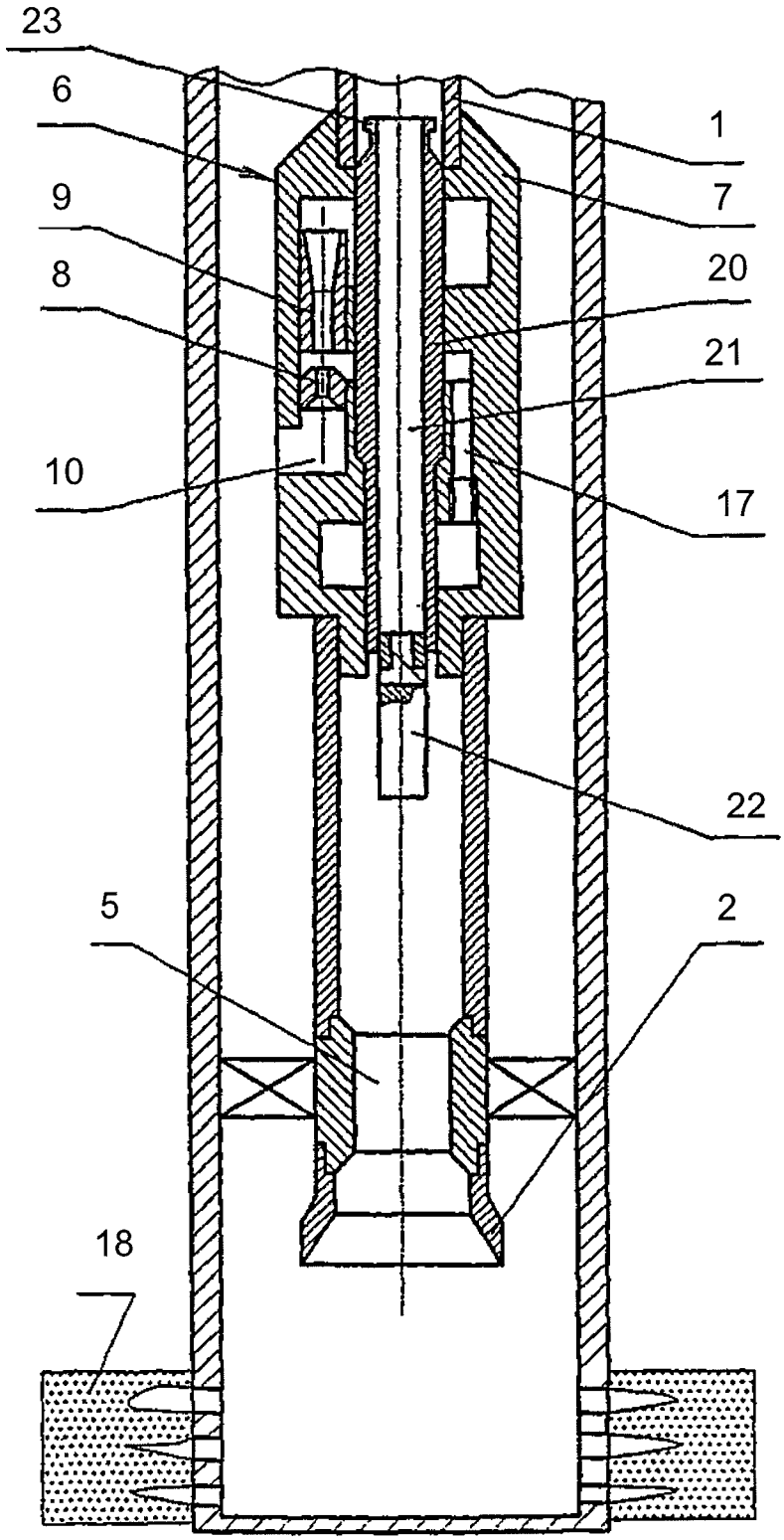
FIG. 5 is a longitudinal section of the well jet device with the blocking insert installed in the through passage.
Figure 6:
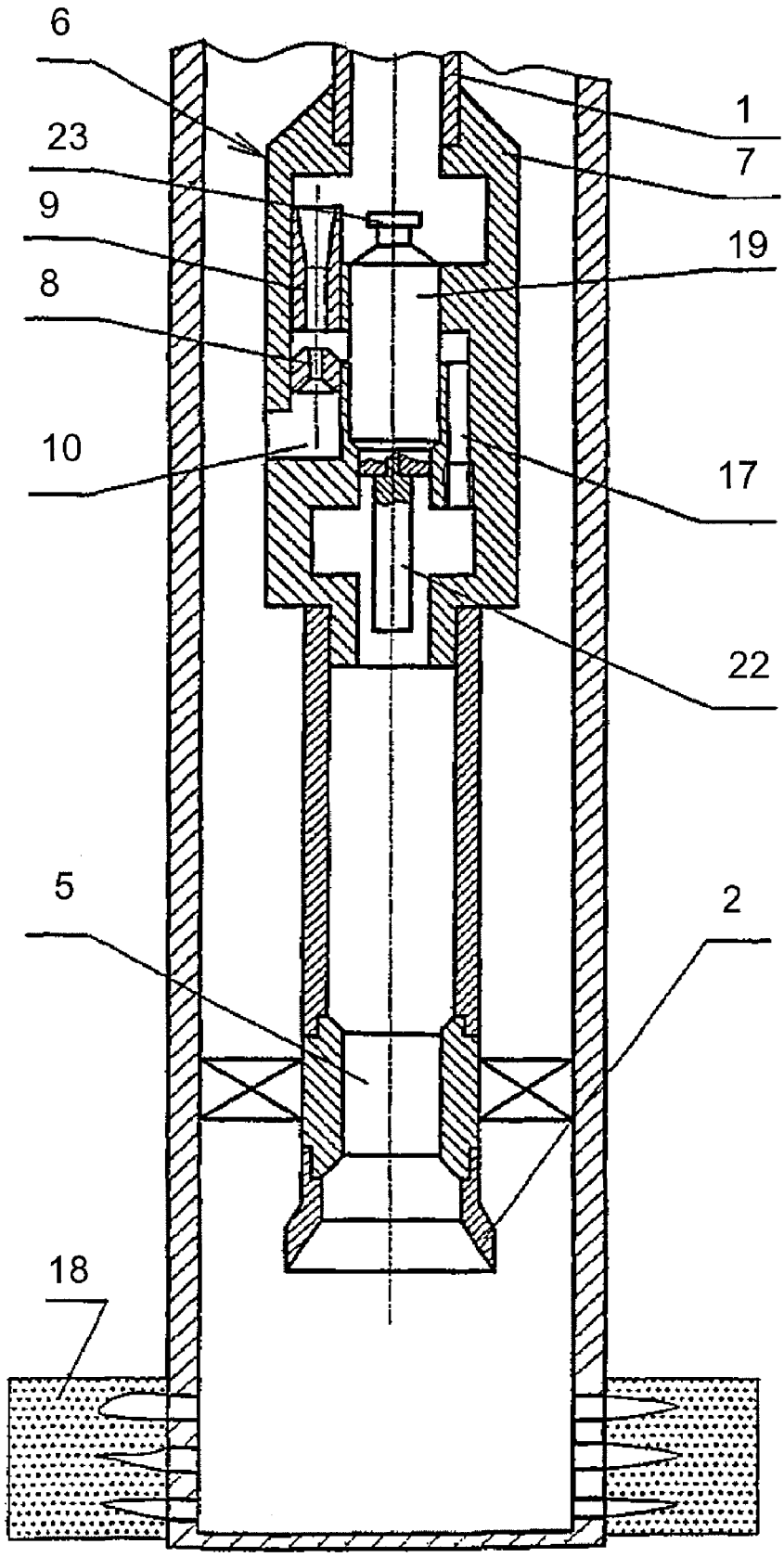
FIG. 6 is a longitudinal section of the well jet device with the depression insert and an autonomous instrument installed in the through passage.

The proposed well jet device for testing and developing wells, which is served to implement the described method, comprises, installed on the piping string 1 down-top, the input cone 2 with the shank 3, the packer 4 with the through passage 5, and the jet pump 6, in the body 7 of which one or several active nozzles 8 are axially arranged, with the respective mixing chamber 9 and the passage 10 for supplying the active medium. In the body 7 of the jet pump 6 the stepped through passage 11 is made with the mounting seat 12 between steps for installing the sealing assembly 13 having the axial channel 14. The said device being provided with the transmitter and receiver-transducer of physical fields 15, which is arranged on the side of the jet pump 6 for entry of the medium pumped out of the well and installed on the cable or wire 16 fed through the axial passage 14 of the sealing assembly 13. The output side of the jet pump 3 is connected to the piping string 1 above the sealing assembly 13. The input side of the passages 17 in the jet pump 6 for supplying the pumped out medium is connected to the piping string 1 below the sealing assembly 13, and the input side of the passage 10 for supplying the working (active) medium to the active nozzle 8 (or the active nozzles 8) is connected to the space surrounding the piping string 1. In the body 7 of the jet pump 6 several passages 17 are made for supplying the pumped out medium. The input cross-section of the input cone 2 is located at a distance h, not lower than the roof of the productive stratum 18. The total area of the cross-sections of the passages 10 for supplying the active medium is not less that the total area of the output cross-sections of the active nozzles 8. The axis of each active nozzle 8 is parallel to the axis of the through passage 11 in the body 7 of the jet pump 6 and is located from the axis of the latter at the distance L being not less than 0.55 diameter $D_1$ of the bigger step in the through passage 11 made in the body 7 of the jet pump 6 or at the distance L being not less than 0.575 diameter $D_2$ of the lesser step in the through passage 11 made in the body 7 of the Jet pump 6. The diameter $D_1$ of the bigger step, which is located below the mounting seat 12, in the through passage 111 in the body 7 of the jet pump 6. The sealing assembly 13 is movably arranged on the well-logging cable or wire 16 fed through the axial passage 14 in the sealing assembly 13 and installed with the possibility of being alternatively replaced by the functional inserts, namely, a hydrostatic testing insert, a depression insert 19, a blocking insert 20 which is made with or without a bypass passage 21, an insert for recording curves of stratum pressure restoration in the under-packer space and an insert for hydrodynamic vibration impact on the near-well zone of the productive stratum 18. The diameter $D_3$ of the axial passage 14 in the sealing assembly 13 is not greater than 0.6 outer diameter $D_4$ of the sealing assembly 13. The axes of the sealing assembly 13 and the functional inserts are aligned with the axis of the through passage 11 in the body 7 of the jet pump 6. The functional inserts are made with the possibility of installing below them autonomous well instruments, e.g., a well pressure gauge 22, as well as have, in their upper part, a tool 23 for delivery and removal of them from the body 7 of the jet pump 6 with the use of cable equipment. The well-logging cable or wire 16 are made with a cap 26 for attaching well instruments. The sealing assembly 13 is made with the possibility of installing it on the well-logging cable or wire 16 without disconnecting the cap 26 from them, the transmitter and receiver-transducer of physical fields being connected to the cap 26 of the well-logging cable or wire 16 with the possibility of being replaced by other well instruments, e.g., a perforator, an ultrasonic transmitter, a thermometer, a pressure gauge, a flowmeter, a sampling device, which all may be lowered, either alternatively or in one assembly, along the through passage 11 in the body 7 of the jet pump 6 on the well-logging cable or wire 16 into the well. The outer diameter $D_5$ of the body 7 of the jet pump 6 is at least 2 mm less than the inner diameter $D_6$ of the casing string 24 in the well where it is installed. The diameter $D_4$ of the sealing assembly 13 is at least 1 mm less than the inner diameter $D_7$ of the piping string 1 above the jet pump 6. The diameter $D_8$ of the transmitter and receiver-transducer of physical fields 15 is at least 1 mm less than the diameter $D_2$ of the lower step of the through passage 11 in the body 7 of the jet pump 6 and than the diameter $D_9$ of the through passage 5 in the packer 4, the diameter $D_{10}$ of the well-logging cable or wire 16 is at least 0.001 mm less than the diameter $D_3$ of the axial passage 14 in the sealing assembly 13. In the lower part of the passages 17 for supplying the pumped out medium the positions 25 for installing check valves or plugs are made.

The described method of operation of the well jet device is implemented as follows.

First, the input cone 2 with the shank 3, the packer 4 and the jet pump 6, in the body 7 of which the stepped through passage 11 with the mounting seat 12 between the steps, are installed onto the piping string 1. The whole assembly is lowered into the well, and the input cone 2 is arranged at a distance h not lower than the roof of the productive stratum 18. Then, the transmitter and receiver-transducer of physical fields 15 is lowered into the well to a level below the jet pump 6. When being lowered into the well, the transmitter and receiver-transducer of physical fields 15 is used for background measurements of temperature and other physical fields in the space from the wellhead to the well bottom, after which it is removed from the well. Then the packer 4 is released, a blocking insert 20 with a well pressure gauge 22 is dropped into the inner cavity of the piping string 1, the blocking insert 20 being seated onto the mounting seat 12 in the through passage 11 in the body 7 of the jet pump 6, the said blocking insert 20 separates the well area into the hole clearance and the space inside the piping string 1. Then the packer 4 is pressure-tested by way of supplying the working agent into the hole clearance. Then the blocking insert 20 is removed with the use of cable equipment, and the transmitter and receiver-transducer of physical fields 15 is lowered into the well together with the sealing assembly 13, which is movably arranged on the well-logging cable or wire 16 above the cap 26 on which the transmitter and receiver-transducer of physical fields 15 is installed. The sealing assembly 13 is installed onto the mounting seat 12 in the through passage 11 of the body 7 of the jet pump 6 while ensuring the possibility of back and forth motion of the well-logging cable or wire 16. After that, the transmitter and receiver-transducer of physical fields 15 is arranged in the explored interval of the productive stratum 18, and, by supplying the working medium to the active nozzle(s) 8 of the jet pump 6, several values of pressure drawdown on the stratum 18 are successively created, and, at each value, bottom-hole pressures, compositions of the fluid coming from the stratum 18 and the well flow rate are measured. Then, the parameters of physical fields of the productive stratum and the stratum fluid and those of the bottom-hole pressures are recorded when moving the transmitter and receiver-transducer of physical fields 15 along the well axis in the speed range from 0.1 to 100 meters per minute and at pressure drawdown values changing stepwise in the range from 0.01 to 0.99 stratum pressure or at a set value of pressure drawdown when the jet pump 6 is either operated or shut down. Then, the transmitter and receiver transformer of physical fields 15 is lifted out of the well and at the same time physical fields from the input cone 2 to the wellhead are registered, and the functional insert for recording curves of stratum pressure restoration in the under-packer zone is lowered on the well-logging cable or wire 16, the said insert being provided with a pressure sensor and a sampling device, and installed in the through passage 11 in the body 7 of the of the jet pump 6, a required pressure drawdown on the stratum 18 is created with the use of the jet pump 6, and, after sharp stopping of supplying the liquid working medium to the jet pump 6, a stratum pressure restoration curve for the under-packer well zone is recorded. Recording of stratum pressure restoration curves may be done repeatedly at different initial pressure drawdown on the stratum 18. After that, the results of exploration and testing the well are processed, and a decision is taken whether other repair works on the well are necessary in order, e.g., to raise its productivity or ensure waterproofing, such works being conducted with the use of the assembly, being in the well, with the jet pump 6, as well as with the alternatively changed functional inserts as well as instruments lowered into the well with the sealing assembly 13 on the well-logging cable or wire 16, e.g., a perforator, an ultrasonic transmitter, a sampling device, a powder-charge pressure generator, etc., in particular with the use of an ultrasonic transmitter the stratum is impacted by acoustic waves in the pressure drawdown mode in order to de-mud the productive stratum 18, by using an ultrasonic generator with frequency switching and selective acting upon, first, less permeable and, then, more permeable seams of the productive stratum 18, and an increase in the well output is monitored. After completion of the said works the cycle of well exploration is repeated.

INDUSTRIAL APPLICABILITY

This invention may be used in the oil industry for conducting repair and insulation works, repair and restoration works as well as in testing and developing wells in other industries where various liquid and gaseous media are extracted out of wells.

What is claimed is:

1. The well jet device for testing and developing wells, comprising, installed on a piping string down-top, an input cone with a shank, a packer with a through passage and a jet pump, in a body of which one or several active nozzles with their respective mixing chambers and passages for supplying an active medium are axially arranged, and a stepped through passage is made with a mounting seat between steps for installing a sealing assembly having an axial passage, said device being provided with a transmitter and a receiver-transducer of physical fields, which is arranged at the jet pump side for entry of the medium pumped out of the well and installed on a cable or a wire fed through the axial passage of the sealing assembly, the output of the jet pump is connected to the piping string above the sealing assembly, the input side of the jet pump passage for supplying pumped out medium is connected to the piping string below the sealing assembly, and the input side of the passage for supplying the working medium to active nozzle is connected to space surrounding the piping string, and in the body of the jet pump several passages for supplying the pumped out medium are made, an input cross-section of the input cone is located not lower than the roof of a productive stratum, the total area of the cross-sections of the passages for supplying the active medium is not less that the total area of the output cross-sections of the active nozzles, the axis of each active nozzle is parallel to the axis of the through passage in the body of the jet pump and is located from the latter at the distance L being not less than 0.55 diameter $D_1$ of the bigger step in the through passage made in the body of the jet pump or at the distance L being not less than 0.575 diameter $D_2$ of the lesser step in the through passage made in the body of the jet pump, the sealing assembly is movably arranged on the well-logging cable or a wire fed through axial passage in the sealing assembly and installed with the possibility of being alternatively replaced by the functional inserts, including at least one of a hydrostatic testing insert, a depression insert, a blocking insert which is made with or without a bypass passage, an insert for recording curves of stratum pressure restoration in the under-packer space and an insert for hydrodynamic vibration impact on the near-well zone of the productive stratum; the diameter $D_3$ of the axial passage in the sealing assembly is not greater than 0.6 outer diameter $D_4$ of the sealing assembly, the axes of the sealing assembly and the functional inserts are aligned with the axis of the through passage in the jet pump; the functional inserts are adapted for installation thereon below autonomous well instruments as well as have, in their upper part, a tool for delivery and removal of them from the body of the jet pump with the use of cable equipment, the well-logging cable or wire are made with a cap for attaching well instruments, the sealing assembly is adapted for installation on the well-logging cable or wire without disconnecting the cap from them, the transmitter and receiver-transducer of physical fields are connected to the cap of the well-logging cable replaceable by other well instruments, including, a perforator, an ultrasonic transmitter, a thermometer, a pressure gauge, a flowmeter, a sampling device, which all may be lowered, either in turns or in one assembly, along the through passage of the jet pump body on the well-logging cable or wire into the well, the outer diameter $D_5$ of the jet pump body being at least 2 mm less than the inner diameter $D_6$ of the casing string in the well where it is installed, the diameter $D_4$ of the sealing assembly being at least 1 mm less than the inner diameter $D_7$ of the piping string above the jet pump, the diameter $D_8$ of the transmitter and receiver-transducer of physical fields being at least 1 mm less than the diameter $D_2$ of the lower step of the through passage in the jet pump body and than the diameter $D_9$ of the through passage in the packer, the diameter $D_{10}$ of the well-logging cable or wire being at least 0.001 mm less than the diameter $D_3$ of the axial passage in the sealing assembly, and in the lower part of the passages for supplying the pumped out medium positions for installing check valves or plugs are made.

2. The method of operation of the well jet unit in testing and developing wells, consisting of installing on a piping string, down-top, of an input cone with a shank, a packer and a jet pump in a body of which a stepped through passage with a mounting seat is made between the steps, lowering that assembly into a well, arranging the input cone not below the roof of a productive stratum, then lowering a transmitter and receiver-transducer of physical fields into the well and arranged below the jet pump, during lowering, taking background measurements of temperature and other physical fields from the wellhead to the well bottom, and removing the transmitter and receiver-transducer of physical fields from the well, then releasing the packer, dropping a blocking insert with a well pressure gauge into the inner cavity of the piping string, the blocking insert being seated onto the mounting seat in the through passage, said blocking insert separating the well area into the hole clearance and the space inside the piping string, then pressure-testing the packer by way of supplying working medium into the hole clearance, then removing the blocking insert with the use of cable equipment, and lowering the transmitter and receiver-transducer of physical fields into the well together with the sealing assembly, which is movably arranged on the well-logging cable or wire above the cap on which the transmitter and receiver-transducer of physical fields is installed, installing a sealing assembly onto the mounting seat in the through passage in the body of the jet pump while ensuring the possibility of back and forth motion of the well-logging cable or wire, then arranging the transmitter and receiver-transducer of physical fields in the explored interval of the productive stratum, and, by supplying the working medium to active nozzle(s) of the jet pump, successively creating several values of pressure drawdown on the stratum, and, at each value, measuring bottom-hole pressures, the composition of the fluid coming from the stratum and the well flow rate after which, recording the parameters of physical fields and those of bottom-hole pressure when moving the transmitter and receiver-transducer of physical fields along the well axis in the speed range from 0.1 to 100 meters per minute and at pressure drawdown values changing stepwise in the range from 0.01 to 0.99 stratum pressure or at a set value of pressure drawdown when the jet pump is either operated or shut down, then lifting the transmitter and receiver transformer of physical fields out of the well and at the same time physical fields from the input cone to a wellhead are registered, and lowering the functional insert for recording curves of stratum pressure restoration in the under-packer zone on the well-logging cable or wire, said insert being provided with a pressure sensor and a sampling device, and installed in the through passage of the jet pump, creating a required pressure drawdown on the stratum with the use of the jet pump, and, sharply stopping of supplying the working medium to the jet pump and thereafter, recording a stratum pressure restoration curve for the under-packer well zone, said recording of stratum pressure restoration curves done repeatedly at different initial pressure drawdown on the stratum, after that processing the results of exploration and testing the well, and taking a decision whether other repair works on the well are necessary in order, to raise its productivity or ensure waterproofing, such works being conducted with the use of the assembly with the jet pump, which is in the well, as well as with alternatively changed functional inserts as well as instruments lowered into the well with the sealing assembly on the well-logging cable or wire, including at least one of a perforator, an ultrasonic transmitter, a sampling device, or a powder-charge pressure generator, in particular with the use of an ultrasonic transmitter the stratum is impacted by acoustic waves in the pressure drawdown mode in order to de-mud the productive stratum, by using an ultrasonic generator with frequency switching and selective acting upon, first, less permeable and, then, more permeable seams of the productive stratum, and monitoring an increase in the well output, and after completion of the said works repeating the cycle of well exploration.

* * * * *